US005521587A

United States Patent [19]

Sawabe et al.

[11] Patent Number: 5,521,587

[45] Date of Patent: May 28, 1996

[54] LIGHT-EMITTING DIODE INDICATOR AND DISPLAY PANEL USING THE SAME

[75] Inventors: Tsutomu Sawabe; Hiroki Ishinaga, both of Kyoto, Japan

[73] Assignee: Rohm Co., Ltd., Kyoto, Japan

[21] Appl. No.: 144,725

[22] Filed: Oct. 28, 1993

Related U.S. Application Data

[63] Continuation of Ser. No. 871,487, Apr. 21, 1992, abandoned.

[30] Foreign Application Priority Data

Jul. 10, 1991 [JP] Japan ..... 3-197143

[51] Int. Cl.[6] ..... G08B 5/22; G09F 9/33

[52] U.S. Cl. ..... 340/815.45; 345/82; 345/39

[58] Field of Search ..... 340/815.45, 815.53, 340/815.75; 345/39, 46, 82; 362/351, 353, 359, 361, 365, 366, 368; 40/554, 574

[56] References Cited

U.S. PATENT DOCUMENTS

| | | | |
|---|---|---|---|
| 3,220,001 | 11/1965 | Hallerberg | 362/359 |
| 4,074,123 | 2/1978 | Wissinger | 362/351 |
| 4,482,943 | 11/1984 | Hogue | 362/361 |
| 4,490,778 | 12/1984 | Collins et al. | 362/361 |
| 4,519,018 | 5/1985 | Rowland | 362/359 |
| 4,520,435 | 5/1985 | Baldwin | 362/361 |
| 4,745,534 | 5/1988 | Brunner | 362/368 |
| 4,967,330 | 10/1990 | Bell et al. | 362/368 |
| 4,972,301 | 11/1990 | Kasboske | 362/368 |

FOREIGN PATENT DOCUMENTS

| | | |
|---|---|---|
| 0210274 | 2/1987 | European Pat. Off. . |
| 0390479 | 10/1990 | European Pat. Off. . |
| 2-16779 | 1/1990 | Japan . |

*Primary Examiner*—Richard Hjerpe
*Assistant Examiner*—Xiao M. Wu
*Attorney, Agent, or Firm*—Brumbaugh, Graves, Donohue & Raymond

[57] ABSTRACT

A plurality of light-emitting diode elements are disposed in a generally cylindrical outer frame of an indicator main body. Recesses are formed on the outer surface of the outer frame so as to be arranged in its circumferential and longitudinal directions. Several ribs are formed on the inner surface of a hood so as to be arranged in its circumferential direction. The ribs of the hood are fitted in selected ones of the recesses of the outer frame to form an indicator. A display panel is constituted by two-dimensionally arranging a large number of the above indicators on a base.

7 Claims, 5 Drawing Sheets

LIGHT-EMITTING DIODE INDICATOR AND DISPLAY PANEL USING THE SAME

This application is a continuation of application Ser. No. 07/871,487, filed on Apr. 21, 1992, now abandoned.

BACKGROUND OF THE INVENTION

The present invention relates to a display panel to be used for displaying advertisements, traffic information, etc., and to an indicator that constitutes such a display panel.

The above type of indicator has a plurality of light-emitting diode elements. And in an indicator proposed in Japanese Patent Application Unexamined Publication No. Hei. 2-6779, a plurality of light-emitting diode elements are disposed in a cylindrical outer case so as to be retracted from its opening plane by a predetermined distance. With this arrangement, the indicator is not exposed to the weather even without a glass plate etc. to cover its front surface. Since no front glass plate is employed, there does not occur such a problem that the glass plate reflects light coming from the front.

However, since the distance between the opening plane of the outer case and the light-emitting diode elements is fixed, the above-described conventional indicator has a problem that it cannot properly accommodate an environment and conditions in its actual use. For example, when ambient light comes from above or the indicator is directed to the north, it is preferred that a cover be provided above the light-emitting diode elements and that in the lower part of the indicator the diode elements be exposed almost completely, to effectively utilize light emitted from the light-emitting diode elements. On the other hand, when ambient light enters the indicator after traveling a path generally in parallel with the indicator, it is preferred that the light-emitting diode elements be shielded sufficiently. The above conventional indicator can accommodate only one of these situations.

SUMMARY OF THE INVENTION

The present invention has been made in view of the above problems in the art, and has an object of providing a light-emitting diode indicator and a display panel in which a shielding state of light-emitting diode elements can be selected in accordance with an environment and conditions in their actual use.

According to the invention, a light-emitting diode indicator comprises:

an indicator main body having an outer frame and a plurality of light-emitting diode elements disposed in the outer frame;

a hood to be mounted on the outer frame of the main body; and mounting means provided in each of the main body and the hood so that the hood is mounted on the outer frame of the main body at a position selected from a plurality of positions.

A display panel of the invention is constituted by two-dimensionally arranging a plurality of the above light-emitting diode indicators.

With the above construction, shielding of the light-emitting diode elements from ambient light can be performed properly by selecting the best position of the hood with respect to the indicator main body. If the fitting means is capable of providing the selection of the hood mounting position from a plurality of positions both in the circumferential direction and in the longitudinal direction of the main body, a large number of variations can be obtained as to the manner of shielding the light-emitting diode elements from ambient light.

DESCRIPTION OF THE PREFERRED EMBODIMENTS

Figure 1:
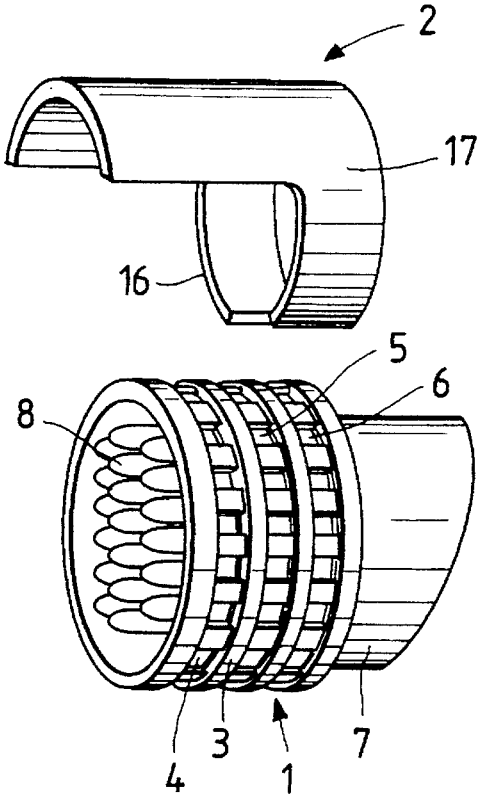
FIG. 1 is an exploded perspective view of a light-emitting diode indicator according to an embodiment of the invention.

An embodiment of the present invention is described hereinafter with reference to the accompanying drawings. FIG. 1 is a view of an indicator according to the embodiment, which separately shows an indicator main body 1 and a hood 2 that is detachable from the main body 1. The main body 1 has, on its outer shell 3, fitting recesses 4, 5 and 6, an adjacent pair of which are spaced from each other in the circumferential direction by an angle of 30°.

A rear fixing portion 7 having a diameter somewhat smaller than the outer shell 3 is unitized with the outer shell 3 via a step. The rear end face of the fixing portion 7 is inclined by an angle of 10° from a plane perpendicular to the longitudinal axis of the main body 1. This structure is employed to direct the whole indicator somewhat downward when the main body 1 is attached to a vertical base, considering the fact that indicators are generally installed at high places. A large number of light-emitting diode elements 8 are disposed in the outer shell 3 at its front portion. A printed circuit board, on which the light-emitting diode elements 8 are mounted in advance, is also provided in the outer shell 3. The front ends of the light-emitting diode elements 8 are flush with the opening plane of the outer shell 3, though the invention is not limited to such a structure.

Figure 2:
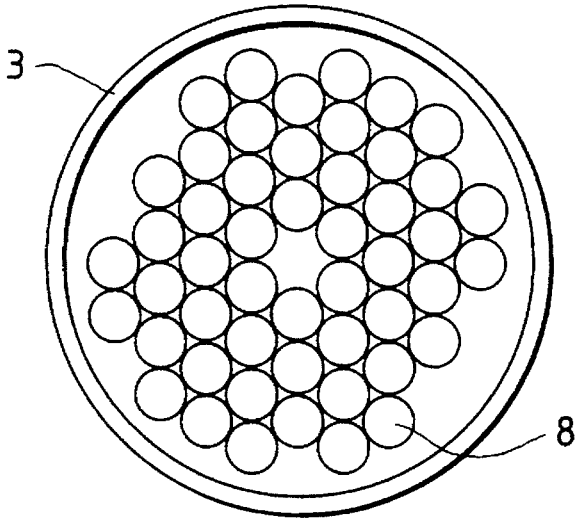
FIG. 2 is a front view of an indicator main body that is a part of the indicator of FIG. 1.
Figure 3:
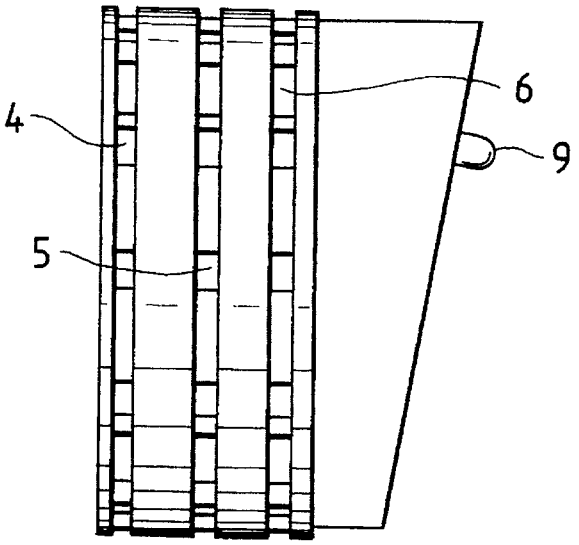
FIG. 3 is a side view thereof.
Figure 4:
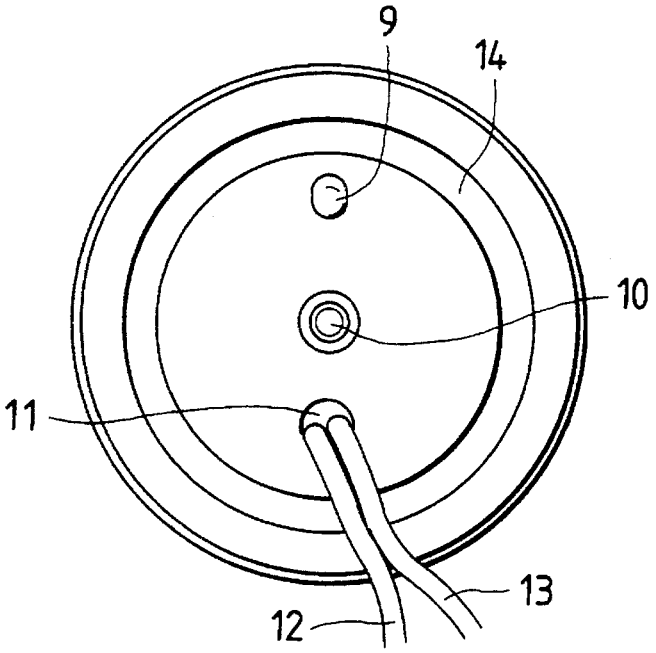
FIG. 4 is a rear view thereof.

FIG. 2 is a front view of the main body 1, FIG. 3 a side view, and FIG. 4 a rear view. In FIGS. 3 and 4, there are shown a protrusion 9 for positioning at the time of installation of the main body 1 on a base, an inserting screw 10 for the fixing purpose, and a hole 11 through which leads 12 and 13 for introducing an electric power for the light-emitting diode elements 8 are inserted. A groove (also see FIG. 7) 14 receives an O-ring (not shown) for sealing when the main body 1 is attached to a base.

Figure 5:
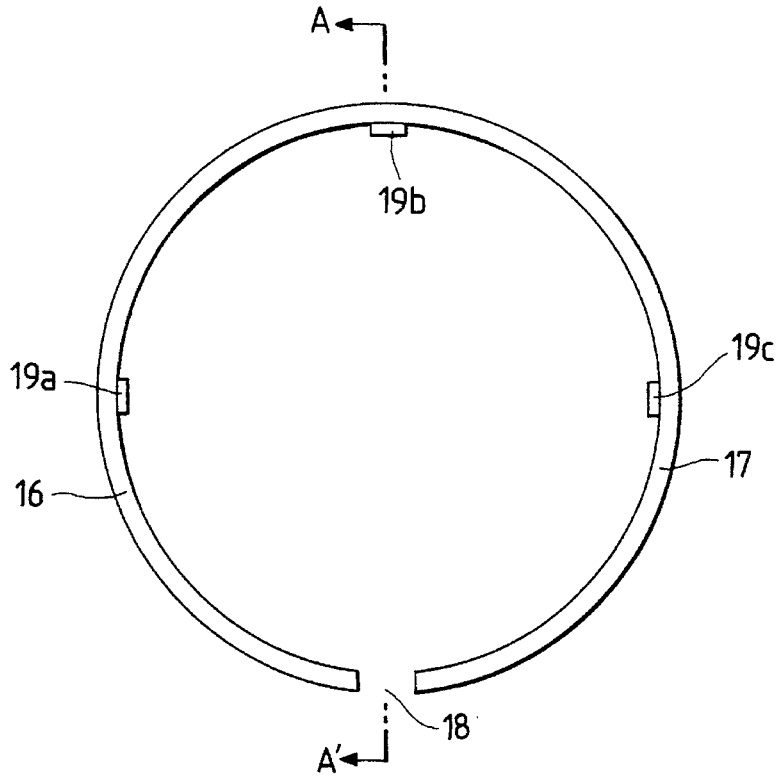
FIG. 5 is a front view of a hood.
Figure 6:
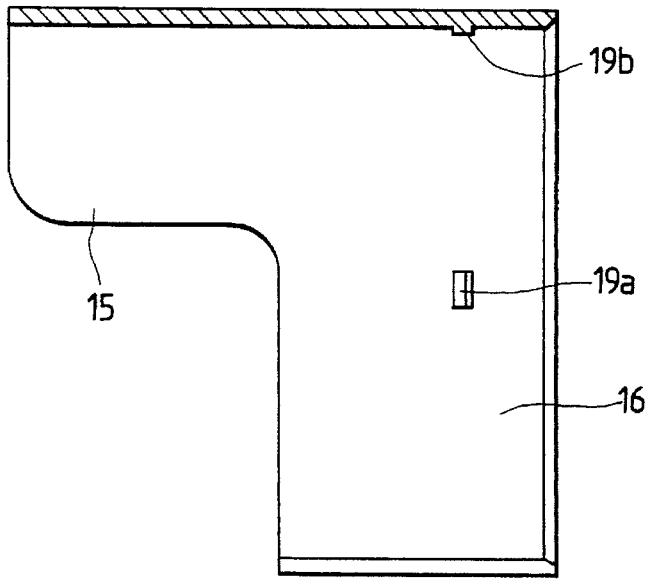
FIG. 6 is a sectional view of the hood taken along line A—A' in FIG. 5.
Figure 7:
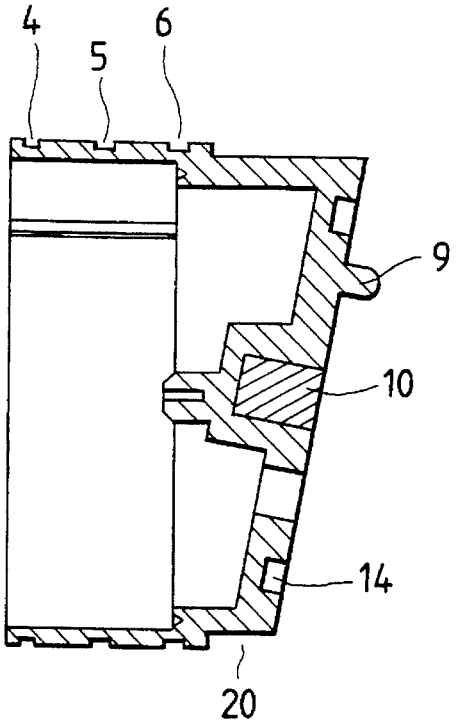
FIG. 7 is a sectional view of a case that is an outer frame of the indicator main body.

FIGS. 5 and 6 show the hood 2. FIG. 5 is its front view, and FIG. 6 is a sectional view taken along line A—A' in FIG. 5. The hood 2 consists of a visor portion 15 and a pair of wings 16, 17. The bottom ends of the wings 16 and 17 are opposed to each other via a gap 18. Being flexible by virtue of the wings 16 and 17, the hood 2 is elastically attached to the main body 1. Further, as shown in FIG. 5, three fitting ribs 19*a*, 19*b* and 19*c* are formed on the inner surface of the hood 2, which are to be fitted in selected ones of the fitting recesses 4, 5 and 6. FIG. 7 is a sectional view showing a case 20 that is the whole outer frame of the main body 1.

According to this embodiment, the attaching position of the hood 2 to the main body 1 is adjustable, i.e., it can be selected from three positions in the longitudinal direction, and from 12 positions in the circumferential direction having intervals of 30°.

Figure 8:
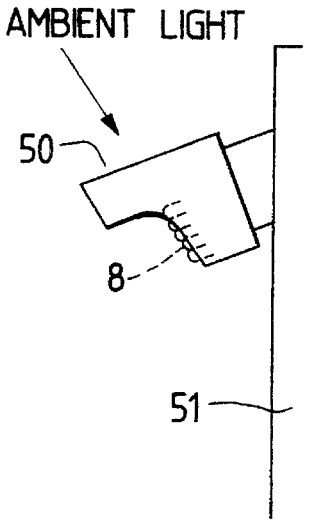
FIG. 8 shows an example of the indicator in its actual use.

FIG. 8 shows how an indicator 50 having the above-described structure is actually used under such a condition that ambient light comes from above. In this case, the ribs 19*a*, 19*b* and 19*c* of the hood 2 are fitted in the rear fitting recesses 6 of the main body 1. As a result, the front ends of the light-emitting diode elements 8 are approximately flush with the front ends of the wings 16 and 17, so that light emitted from the light-emitting diode elements 8 can be utilized effectively.

Figure 9:
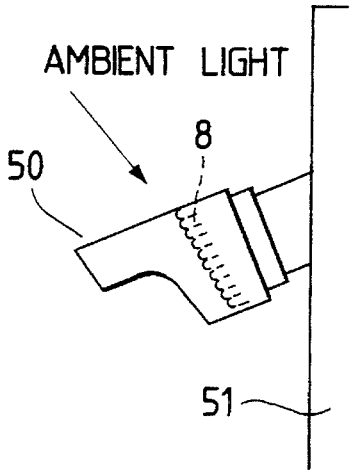
FIG. 9 shows another example of the indicator in its actual use.

On the other hand, FIG. 9 shows how the indicator 50 is actually used under such a condition that ambient light enters the indicator 50 along a path generally in parallel with the indicator 50. In this case, the ribs 19*a*, 19*b* and 19*c* of the hood 2 are fitted in the front fitting recesses 4 of the main body 1. As a result, the wings 16 and 17 of the hood 2 are located sufficiently in front of the light-emitting diode elements 8. That is, in this case, a priority is given to the shielding from ambient light.

In the cases of FIGS. 8 and 9, the hood 2 can further be moved (i.e., rotated) in the circumferential direction so as to be located at a position in the circumferential direction that is most suitable for the purpose of using the indicator 50. Further, in various situations other than FIGS. 8 and 9, good display performance can be obtained by properly positioning the hood 2 in the longitudinal and circumferential directions in accordance with each situation.

While the three ribs 19*a*, 19*b* and 19*c* are provided in the above embodiment, the embodiment can be so modified that only one of these ribs is employed. Alternatively, the number of ribs may be any plural number as long as it does not exceed the number of the recesses 4, 5 or 6 in the circumferential direction. Further, the angular interval in the circumferential direction of the recesses 4, 5 and 6 is not limited to 30°, but may be some other appropriate angle. In this case, the recesses 4, 5 and 6 need not always be provided over the entire circumference.

While in the above embodiment the recesses 4, 5 and 6 have three-step positions in the longitudinal direction of the main body 1, the number of positions is not limited to three but may be any number.

Figure 10:
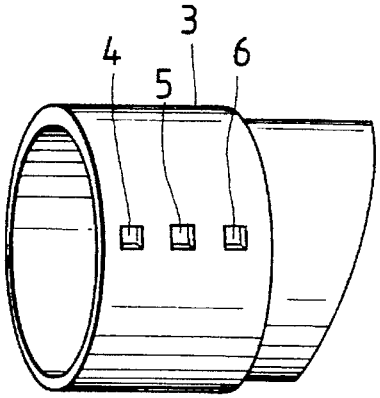
FIG. 10 shows the main part of an indicator main body according to another embodiment.
Figure 11:
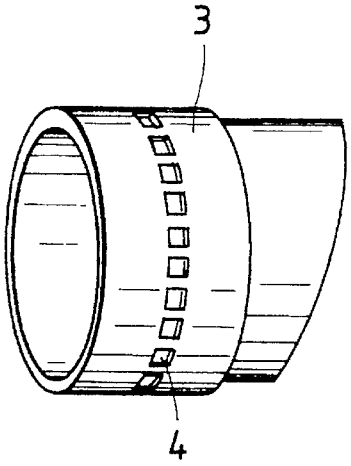
FIG. 11 shows the main part of an indicator main body according to still another embodiment.

FIGS. 10 and 11 show modifications of the above embodiment, in which a recess for the engagement with the hood 2 can be selected only in the longitudinal direction and the circumferential direction, respectively. In the case of the FIG. 10 modification, if the only one recess cannot provide enough fitting force between the hood 2 and the main body 1, a groove extending in the longitudinal direction may be formed on the main body 1 separately with the recesses 4, 5 and 6 and a protrusion or a protrusion strip that is always fitted in such a groove may be formed on the hood 2.

Figure 12:
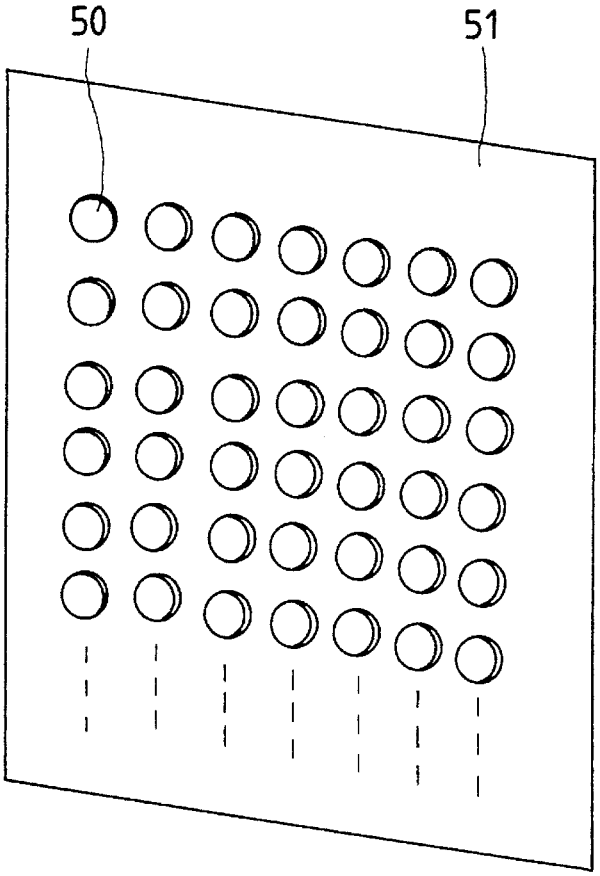
FIG. 12 is a display panel according to an embodiment of the invention.

FIG. 12 shows a display panel in which a large number of above-described indicators 50 are arranged on a base 51. This type of display panel is used for displaying advertisements and traffic information, etc. This display panel can act as a color image display panel by regularly arranging a large number of sets of indicators, each set consisting of red, green and blue indicators.

As described in the foregoing, according to the invention, since the position of the hood is adjustable with respect to the indicator main body, the indicator can assume an ambient light interrupting form that is suitable for an ambient light situation of a place where the indicator is used. Since this advantage can be obtained with the same structure of the hood and main body, no specific burden is incurred in the production of the indicators.

What is claimed is:

1. A light-emitting diode indicator comprising:

an indicator main body having an outer frame and a plurality of light-emitting diode elements disposed in the outer frame;

a hood to be mounted circumferentially around the outer frame of the main body; and mounting means comprising spaced interengageable detent means including a plurality of circumferentially spaced projections and recesses provided in the main body and in the hood and resilient means for urging the detent means into engagement so that the hood may be circumferentially positioned and releasably locked on the outer frame of the main body at any of a plurality of circumferentially spaced positions determined by the detent means to shield the light emitting diode elements from ambient light incident in a selected circumferential direction.

2. The indicator of claim 1, wherein the outer frame assumes a generally cylindrical form.

3. The indicator of claim 2, wherein the spaced interengageable detent means includes a plurality of recesses spaced in a longitudinal direction of the outer frame.

4. The indicator of claim 1, wherein the mounting means comprises a rib formed on an inner surface of the hood and a plurality of recesses formed on an outer surface of the outer frame, and wherein the rib of the hood is fitted in one of the plurality of recesses of the outer frame.

5. The indicator of claim 2, wherein the hood comprises a visor portion for shielding, when the hood is mounted on the outer frame of the main body, the light-emitting diode elements from ambient light, and a pair of flexible wings for elastically engaging the hood with the outer frame.

6. A display panel comprising a plurality of light-emitting diode indicators arranged two-dimensionally, each of the indicators comprising:

an indicator main body having an outer frame and a plurality of light-emitting diode elements disposed in the outer frame;

a hood to be mounted circumferentially around the outer frame of the main body; and mounting means comprising spaced interengageable detent means including a plurality of circumferentially spaced projections and recesses provided in the main body and in the hood and resilient means for urging the detent means into engagement so that the hood may be circumferentially positioned and releasably locked on the outer frame of the main body at any of a plurality of circumferentially spaced positions determined by the detent means to shield the light emitting diode elements from ambient light incident in a selected circumferential direction.

7. The display panel of claim 6, wherein the display panel comprising a plurality of sets of the light-emitting diode indicators arranged two-dimensionally, each set comprising three light-emitting diode indicators that emits three primary color light beams, respectively.

* * * * *